US005163750A

United States Patent [19]

Natori

[11] Patent Number: 5,163,750

[45] Date of Patent: Nov. 17, 1992

[54] LIGHT APPARATUS

[75] Inventor: Takehisa Natori, Kanagawa, Japan

[73] Assignee: Sony Corporation, Tokyo, Japan

[21] Appl. No.: 850,954

[22] Filed: Mar. 11, 1992

[30] Foreign Application Priority Data

Mar. 20, 1991 [JP] Japan ..... 3-080430

[51] Int. Cl.[5] ..... F21V 7/08

[52] U.S. Cl. ..... 362/310; 362/261; 362/293

[58] Field of Search ..... 362/310, 32, 261, 297, 362/298, 299, 293, 329

[56] References Cited

U.S. PATENT DOCUMENTS

| | | | |
|---|---|---|---|
| 1,815,751 | 7/1931 | Whalen | 362/310 |
| 2,441,824 | 5/1948 | Kurlander | 362/310 |
| 3,088,023 | 4/1963 | Ayroldi | 362/310 |
| 4,389,968 | 6/1983 | Cibie | 362/61 |
| 4,883,333 | 11/1989 | Yanez | 362/32 |
| 4,958,263 | 9/1980 | Davenport et al. | 362/32 |

*Primary Examiner*—Richard R. Cole

*Attorney, Agent, or Firm*—Ronald P. Kananen

[57] ABSTRACT

A light apparatus disclosed is high in utilization factor of light, simple in structure and suitable for mass production. The light apparatus includes a hollow single-part reflecting plate (11) having a spheroidal mirror on an inner face thereof and a discharge tube (13) mounted at a forward opening of the reflecting plate. The discharge tube has a double layer tube structure consisting of an elongated light emitting tube (16) and an outer tube (18) surrounding the light emitting tube. A reflecting face (26) is formed on the outer tube such that it connects to the spheroidal mirror to form a closed spheroidal face. The reflecting face is formed by mounting a cold mirror on a surface of the outer tube, and a light extracting portion (25) is formed on an outer wall of the outer tube by mounting a cold filter thereat. Light reflected from the light emitting tube is repetitively reflected by the reflecting plate and the reflecting face so that almost all of the light is discharged through the light extracting portion.

14 Claims, 4 Drawing Sheets

LIGHT APPARATUS

BACKGROUND OF THE INVENTION

1. Field of the Invention

This invention relates to a light apparatus for use with an equipment for projecting uniform light in a particular direction, such as a liquid crystal projector, an OHP (overhead projector), or the like.

2. Description of Related Art

Various light apparatus are already known. An exemplary one of such conventional light apparatus is shown in FIG. 5. Referring to FIG. 5, the conventional light apparatus shown is constructed for use with an an overhead projector and includes a reflecting plate 1 formed in a spherical shape of an arcuate section and a discharge tube 2 in the form of a bulb such as a halogen lamp disposed at the center of the sphere of the reflecting plate 1. Thus, part of light emitted from the discharge tube 2 and advancing rearwardly toward the reflecting plate 1 is reflected forwardly by the reflecting mirror 1 so as to make the most of the light emitted from the discharge tube 2.

Another exemplary one of a conventional light apparatus is shown in FIG. 6. Referring to FIG. 6, the conventional light apparatus shown is employed for an equipment wherein parallel rays of light are required, such with as a liquid crystal projector, and includes an elongated discharge tube 3 such as a metal halide lamp and a reflecting plate 4 of a paraboloid of revolution disposed behind and around the discharge tube 3 such that part of output light of the discharge tube 3 (light emitted in a hatched area U in FIG. 6) is reflected by the reflecting plate 4 so as to produce parallel rays of light.

In such light apparatus which produce rays of light in a particular direction as described just above, part of the light emitted from the discharge tube 3 is reflected by the reflecting plate 4 so that light may be outputted in the particular direction, that is, in the rightward direction in FIG. 6. However, light emitted from the discharge tube 3 and advancing rearwardly toward the reflecting plate 4 partially leaks rearwardly through a center hole 4*a* of the reflecting plate 4 in which the discharge tube 3 is fitted. Consequently, light which is actually outputted in the particular direction of the light apparatus is part of the light emitted from the discharge tube 3. Accordingly, the utilization factor of emitted light is low.

Thus, in order to provide a solution to the problem described above, the inventor of the present invention has proposed such a light apparatus as shown in FIG. 7 in Japanese Patent Application No. 2-272153. Referring to FIG. 7, the light apparatus includes a reflecting plate 5 formed as a spheroid or ellipsoid of revolution. The reflecting plate 5 has a light discharging hole 6 formed at a portion thereof at an end of the major axis of the spheroid, and a discharge tube 7 is assembled to the reflecting plate 5 such that it is positioned at either one of two focuses $F_1$ and $F_2$ of the spheroid and extends perpendicularly to the major axis of the spheroid. With the light apparatus, most of the light generated from the discharge tube 7 is outputted in a particular direction, that is, in the rightward direction in FIG. 7, through the light discharging hole 6.

However, in order to manufacture the reflecting plate 5 of the light apparatus, a first reflecting plate 5*a* and a second reflecting plate 5*b* which are a pair of longitudinal halves of the reflecting plate 5 are formed separately from each other. Then the first and second reflecting plates 5*a* and 5*b* are coupled to each other at opening faces thereof along a plane perpendicular to the major axis of the spheroid at the center of the major axis in order to make the reflecting plate 5. Further, the second reflecting plate 5*b* in which the light discharging hole 6 is formed and on which a mounting portion for the discharge tube 7 is provided has a cutaway portion 8 of a substantially U-shaped section formed at an end portion thereof as shown in FIG. 8 at a following step. Then discharge tube 7 is inserted into and secured to the cutaway portion 8 of the second reflecting plate 5*b*, whereupon an end of the cutaway portion 8 is left as the light discharging hole 6. Accordingly, at the location of the reflecting plate 5 where the cutaway portion 8 is formed, light cannot be reflected, and accordingly, light emitted from the discharge tube 7 and advancing to the cutaway portion 8 is directly discharged outwardly and cannot be outputted in the particular direction. Consequently, the utilization factor becomes deteriorated. Further, since the manufacturing method not only requires such a following step as described above but also involves machining of the reflecting plate 5, which is comparatively small in thickness, the manufacture of the light apparatus is complicated and is low in mass productivity.

Since it is necessary to make the occupied area of the cutaway portion 8 as small as possible in order to assure a high utilization factor of light, the discharge tube 7 is formed as a one layer tube and has its light emitting portion exposed outwardly. Consequently, if a finger inadvertently touches a surface of the light emitting portion of the discharge tube 7, the transparency of the discharge tube where the finger touches may be deteriorated into a non-transparent condition to thereby decrease the output of light. Accordingly, care must be taken for handling of the discharge tube 7. Further, when the discharge tube 7 is to be exchanged, for example, due to its failure, such exchanging operation must be performed carefully, which is cumbersome.

SUMMARY OF THE INVENTION

It is an object of the present invention to provide a light apparatus which is high in the utilization factor of light and suitable for mass production.

It is another object of the present invention to provide a light apparatus wherein the light generator is easy to handle.

In order to attain the objects described above, according to an aspect of the present invention, there is provided a light apparatus which comprises a reflecting plate having a hollow spheroidal profile which is a shape obtained by revolving an ellipse around its major axis, the reflecting plate having an inner face formed as a spheroidal mirror which has first and second focuses, the reflecting plate being cut away along a plane perpendicular to the major axis adjacent the second focus to form an opening, an internal mirror mounted in the opening of the reflecting plate in such a manner as to connect to the spheroid of the reflecting plate to close the inner face of the reflecting plate to form part of the spheroidal mirror, and a light emitting member formed integrally with the internal mirror and including a light source member accommodated therein at the second focus of the spheroidal mirror, the light emitting member having a light discharging portion formed at a portion thereof at an end of the major axis of the spheroidal mirror.

According to another aspect of the present invention, there is provided a light apparatus which comprises a reflecting plate having a hollow spheroidal profile which is a shape obtained by revolving an ellipse around its major axis, the reflecting plate having an inner face formed as a spheroidal mirror which has first and second focuses, the reflecting plate being cut away along a plane perpendicular to the major axis adjacent the first focus to form an opening, an internal mirror mounted in the opening of the reflecting plate in such a manner as to connect to the spheroid of the reflecting plate to close the inner face of the reflecting plate to form part of the spheroidal mirror, and a light emitting member formed integrally with the internal mirror and including a light source member accommodated therein at the first focus of the spheroidal mirror, the reflecting plate having a light discharging portion formed at a portion thereof at an end of the major axis of the spheroidal mirror adjacent the second focus of the spheroidal mirror.

With the light apparatus, since the light emitting member mounted in the opening of the reflecting plate is formed integrally with the internal mirror which connects to the spheroid of the reflecting plate to close the inner face of the reflecting plate to form part of the spheroidal mirror, light which is emitted from the light source member but does not advance directly to the light discharging portion is reflected one or several times by the spheroidal mirror of the reflecting plate and/or the internal mirror past the first and second focuses of the spherical mirror and then finally passes the second focus adjacent the light discharging portion so that it is discharged outwardly through the light discharging portion.

Consequently, almost all of the components of light radiated from the light source member are outputted through the light discharging portion. Accordingly, the utilization factor of light of the light apparatus is very high.

Further, since the light emitting member is constructed as part of the reflecting face, it is possible to construct the reflecting plate from a single part having a comparatively large opening therein. Consequently, the number of parts is decreased and also the assembling operation is simplified. Accordingly, the light apparatus can be produced in mass.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENTS

Figure 1:
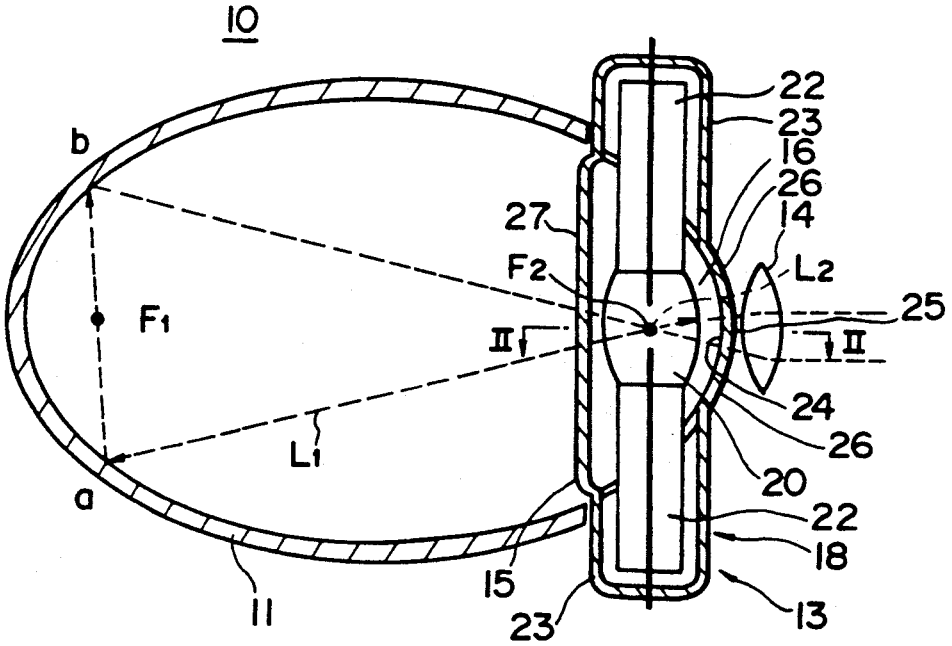
FIG. 1 is a schematic sectional view of a light apparatus showing a first preferred embodiment of the present invention.
Figure 2:
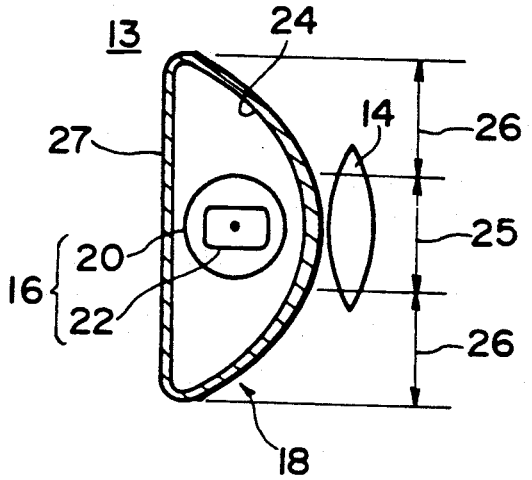
FIG. 2 is a sectional view taken along line II—II of FIG. 1.

Referring first to FIGS. 1 and 2, there is shown a light apparatus to which the present invention is applied. The light apparatus 10 shown is constructed so as to produce parallel rays of light and is suitably used for a liquid crystal projector. The light apparatus 10 includes a reflecting plate 11 in the form of a hollow spheroid or ellipsoid of revolution having an inner face formed as a spheroidal mirror, a high voltage discharge tube 13 mounted at a forward portion of the reflecting plate 11 and serving as a light reflecting member, and a convex lens 14 disposed on the outer side of the discharge tube 13.

The inner face spheroidal mirror of the reflecting plate 11 is formed from a dichroic mirror which only reflects visible rays of light but transmits infrared rays therethrough. A right end portion in FIG. 1 of the spheroidal mirror in its longitudinal direction is cut away in a plane perpendicular to the major axis such that a forward opening 15 is formed in the reflecting plate 11. The forward opening 15 is formed at an arbitrary position displaced outwardly from the minor axis but inwardly of the second focus $F_2$ with respect to the first focus $F_1$ of the reflecting plate 11.

A metal halide lamp is employed as the discharge tube 13 and is constructed in a double layer tube structure including an elongated light emitting tube 16 and an outer tube 18 surrounding the light emitting tube 16. The light emitting tube 16 has a light emitting portion 20 and a pair of electrode bar portions 22 extending outwardly from the opposite sides of the light emitting portion 20. The discharge tube 13 is mounted in the forward opening 15 of the reflecting plate 11 such that the light emitting portion 20 is positioned at the second focus $F_2$ of the inner face spheroidal mirror of the reflecting plate 11.

The outer tube 18 has such a profile that it has, around end portions of the electrode bar portions 22 of the discharge tube 13, a pair of hollow cylindrical portions 23 having an inner diameter a little greater than an outer diameter of the electrode bar portions 22. Around the light emitting portion 20 and around base end portions of the electrode bar portions 22 of the discharge tube 13, the outer tube 18 has a wall 24 which is positioned on the outer side when it is mounted in position on the reflecting plate 11. The wall 24 of the outer mirror 18 connects to the spheroidal mirror of the reflecting plate 11 to form a closed spheroidal face. Accordingly, the outer tube 18 is shaped such that it has a focus at the second focus $F_2$ of the spheroidal mirror of the reflecting plate 11. A light discharging portion 25 is formed at a central portion of the outer wall 24 of the outer tube 18 and a cold filter, which passes visible rays therethrough, is applied to the light discharging portion 25. A cold mirror, which only reflects visible rays but transmits infrared rays as well as ultraviolet rays therethrough, is applied to a portion of the outer wall 24 of the outer tube 18 around the light discharging portion 25 to constitute a reflecting mirror 26 in the form of an internal mirror. Meanwhile, an inner wall 27 of the outer tube 18 is formed as a flat transparent glass plate.

The convex lens 14 is disposed such that the optical axis thereof may coincide with the major axis of the spheroidal mirror of the reflecting plate 11 and a focus thereof may coincide with the light emitting portion 20 of the discharge tube 13.

The reflecting plate 11 and the discharge tube 13 are assembled to each other such that the outer tube 18 of the discharge tube 13 is inserted in position into the forward opening 15 of the reflecting plate 11 with the inner wall 27 thereof directed inwardly, that is, leftwardly in FIG. 1. Next, coupling portions of the inner wall 27 and reflecting plate 1 are coupled to each other at outer peripheries thereof by means of a jig or the like.

In the light apparatus described above, the light discharging portion 25 of the outer tube 18 of the discharge tube 13 is formed from a cold filter. This eliminates a cold filter which would be installed separately on the outer side of a light radiating hole of a conventional light apparatus and, accordingly, achieves simplification in structure.

Since the reflecting plate 11 and the reflecting face 26 formed on the outer tube 18 of the discharge tube 13 are formed from a material which passes infrared rays therethrough as described hereinabove, while the light emitting portion 20 of the light emitting tube 16 is accommodated in the spheroidal spacing in the substantially closed condition, the inside of the spheroidal spacing will not be put into a very high temperature condition.

Further, since the discharge tube 13 has a double layer tube structure, there is no possibility that the light emitting tube 16 in the inside of the discharge tube 13 is touched directly by a finger or the like upon an assembling operation of the light apparatus and upon an exchanging operation of the discharge tube 13. Consequently, the transparency of the light emitting tube 16 will not be deteriorated and the life of the discharge tube 13 will be enhanced.

Rays of light emitted from the discharge tube 13 of the light apparatus 10 follow such loci as described below. In particular, part of light emitted from the discharge tube 13 advances rearwardly as typically indicated by a component $L_1$ of light in FIG. 1. The component $L_1$ of light is first reflected at a point a on the spheroidal mirror of the reflecting plate 11, then passes the first focus $F_1$ of the spheroidal mirror, and is then reflected at another point b on the spheroidal mirror, whereafter it passes the second focus $F_2$ of the spheroidal mirror and finally comes to the light discharging portion 25 of the outer tube 18 of the discharge tube 13. Thus, components of light which are emitted forwardly from the discharge tube 13 and components of light which are emitted rearwardly from the discharge tube 13 and advance forwardly past the second focus $F_2$ after repetitive reflections from the spheroidal mirror of the reflecting plate 11 are projected, when they come to the light discharging portion 25 of the outer tube 18 of the discharge tube 18, outwardly through the light discharging portion 25. However, those of such components of light which come to any other portion of the outer tube 18 of the discharge tube 13 than the light discharging portion 25, that is, to the reflecting face 26, are reflected by the reflecting face 26 and thus advance toward the first focus $F_1$. Consequently, light emitted from the discharge tube 13 is projected outwardly either immediately or after one to several reflections by the reflecting plate 11 and/or the reflecting face 26 of the outer tube 18 of the discharge tube 13 and after passing through the two focuses $F_1$ and $F_2$ of the spheroidal mirror, through the light discharging portion 25 of the outer tube 18, and finally passing the second focus $F_2$. The light thus discharged is collimated into parallel rays of light by the convex lens 14 and outputted as such from the light apparatus.

In this instance, components of light radiated forwardly from the discharge tube 13 and directed toward the light discharging portion 25 of the outer tube 18 of the discharge tube 13 are discharged outwardly through the light discharging portion 25 without being reflected, as represented by a component $L_2$ of light, since the light emitting portion 20 of the discharge tube 13 is disposed at the position of the focus of the convex lens 14. Also such components of light are outputted as parallel rays of light by way of the convex lens 14.

Figure 7:
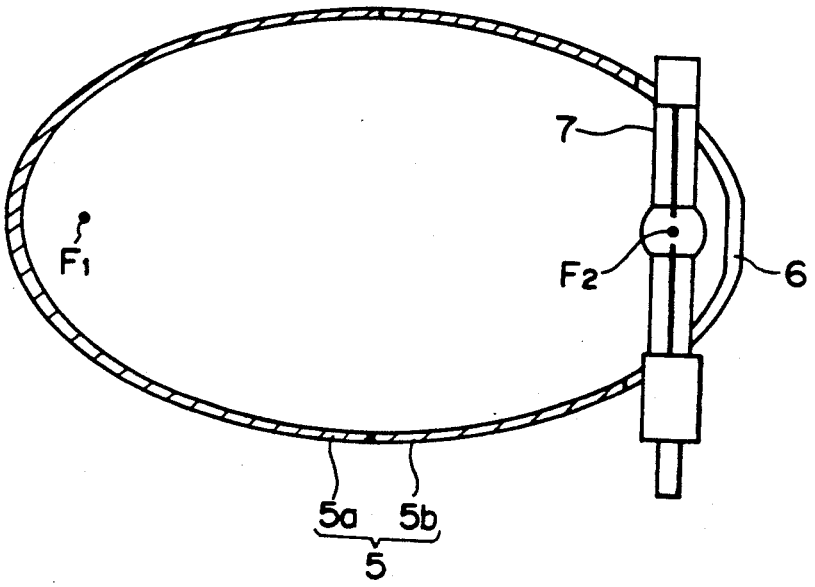
FIG. 7 is a schematic sectional view showing a light apparatus proposed previously by the inventor of the present application.
Figure 8:
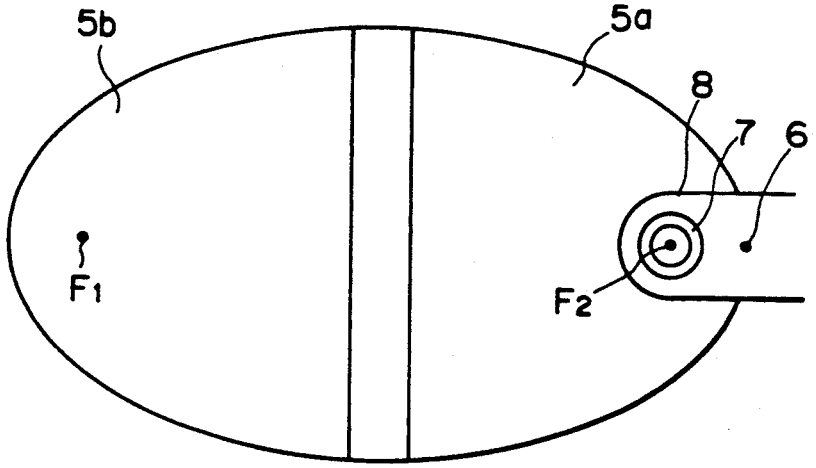
FIG. 8 is a side elevational view of the light apparatus of FIG. 7.

Consequently, almost 100% of light emitted from the discharge tube 13 can be utilized as parallel rays of light. Accordingly, the light apparatus has a very high utilization factor of light. In particular, in the present light apparatus, the components of light which are emitted from the discharge tube 13 but cannot be utilized effectively are only those components of the light which are directed to a pair of intersecting portions A between the reflecting face 26 of the outer tube 18 and the cylindrical portions 23 of the outer tube 18 which cover the electrode bar portions 22 of the light emitting tube 16. Thus, an area B of the outer tube 18 defined by an alternate long and two short dashes line in FIG. 3, and corresponding to the cutaway recessed portion 6 of the reflecting plate 5 for receiving the discharge tube 7 therein in the conventional light apparatus described hereinabove with reference to FIGS. 7 and 8, also serves as the reflecting mirror 26 effectively.

It is to be noted that the cross sectional area of output parallel rays of light can be changed readily by changing the size of the light discharging portion 25 of the outer tube 18 of the discharge tube 15. It may also be changed by moving the convex lens 14 toward or away from the light discharging portion 25 and using a lens of an appropriate diameter as the convex lens 14 or by some other suitable means. For example, parallel rays of light having a greater cross sectional area are obtained by disposing a convex lens of a greater diameter at a position spaced away from the light discharging portion 25. However, in any case, the focal position of the convex lens must necessarily be set to the second focus $F_2$.

Accordingly, the light apparatus of the embodiment described above can be utilized for a liquid crystal projector whether a screen of liquid crystal thereof is great or small, and can supply parallel rays of light of a uniform distribution particularly to such liquid crystal screen of a small size.

It is to be noted that the discharge tube 13 is not limited to a metal halide lamp described above, and various discharge tubes such as, for example, a xenon tube, a mercury-arc lamp and so forth, can be employed as the discharge tube 13.

Figure 3:
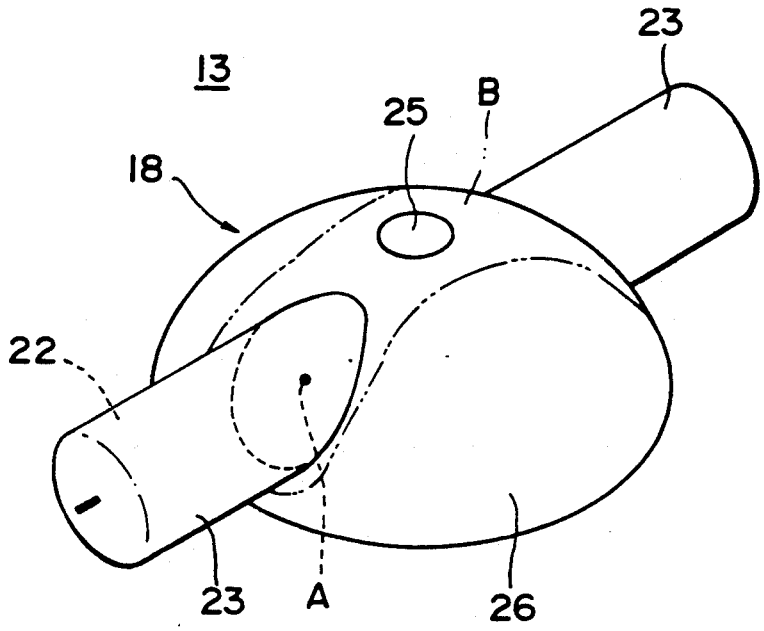
FIG. 3 is a perspective view of a discharge tube of the light apparatus of FIG. 1.
Figure 4:
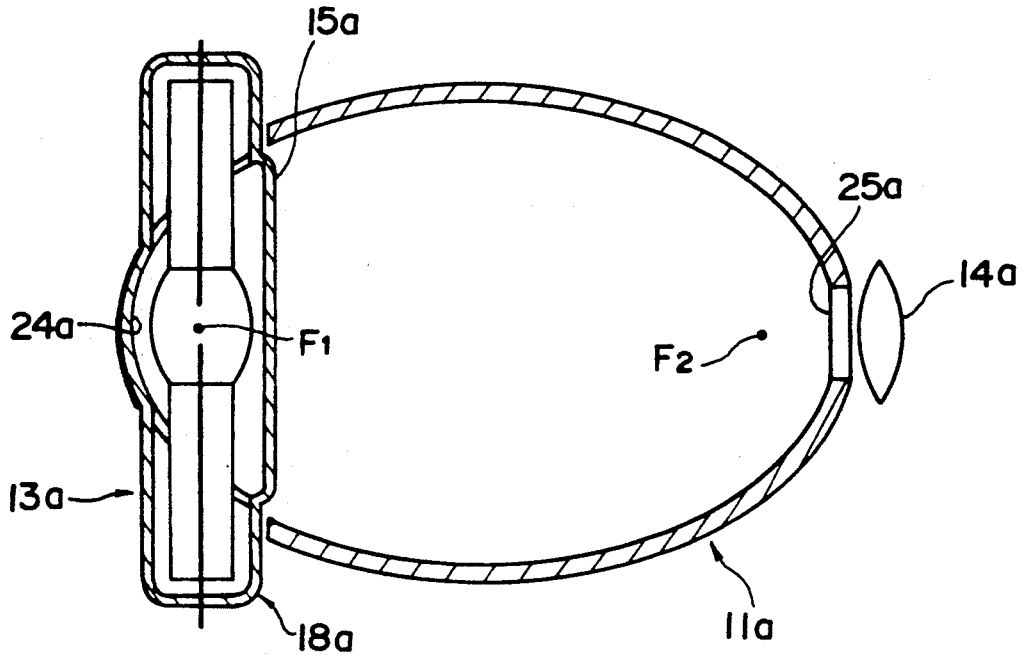
FIG. 4 is a schematic sectional view of another light emitting apparatus showing a second preferred embodiment of the present invention.
Figure 5:
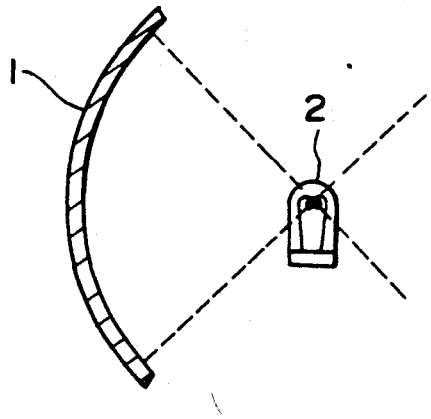
FIG. 5 is a schematic sectional view showing a conventional light emitting apparatus for use with an overhead projector.
Figure 6:
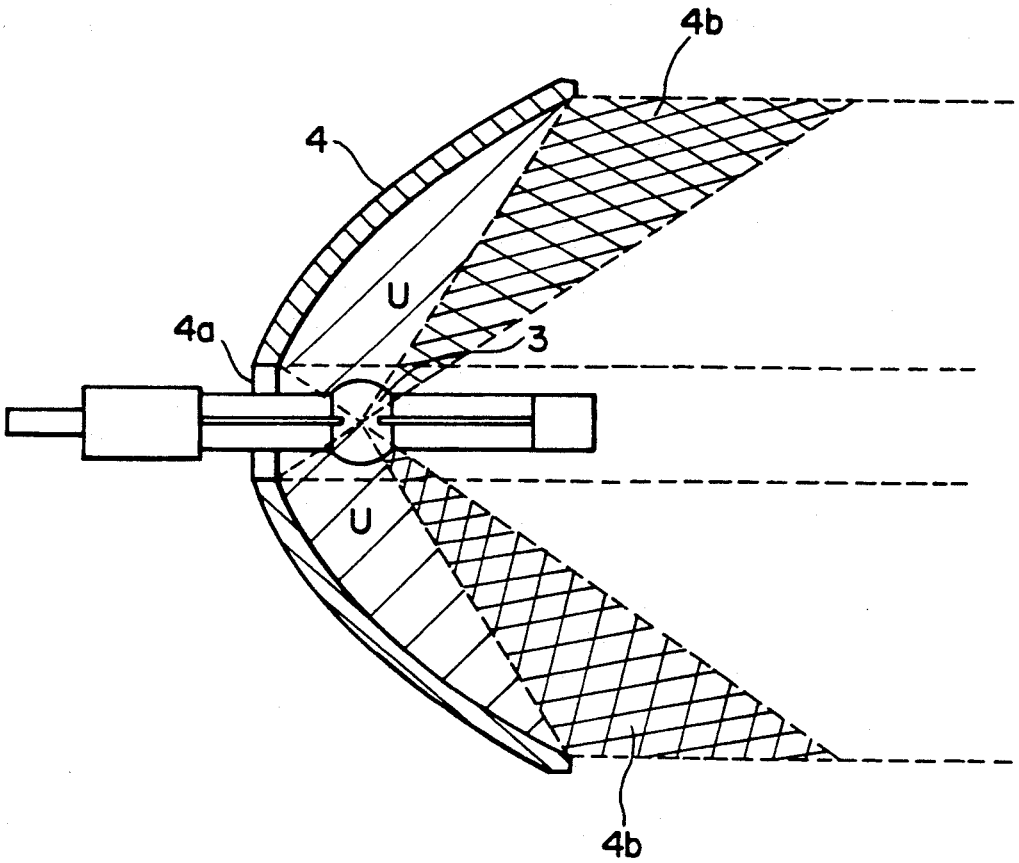
FIG. 6 is a schematic sectional view showing another conventional light apparatus for use with a liquid crystal projector.

Referring now to FIG. 4, there is shown a light apparatus according to a second embodiment of the present invention. The present light apparatus is a modification to the light apparatus of FIGS. 1 to 3 described hereinabove principally in that a discharge tube 13*a* is mounted adjacent a first focus $F_1$ of a spheroidal mirror of a reflecting plate 11*a*. Thus, the reflecting plate 11*a* has a pair of openings 15*a* and 25*a* formed at the opposite end portions of the major axis thereof. The opening 15*a* of the reflecting plate 11*a* is formed at a rear end portion on the major axis in the reflecting plate 11*a* and has the discharge tube 13*a* mounted therein while the light discharging opening 25*a* is formed at a front end portion on the major axis and discharges light therethrough. The light discharging portion or opening 25*a* may be formed simultaneously upon formation of the reflecting plate 11*a* or may otherwise be formed by cutting the reflecting plate 11*a* at a predetermined position at a following step.

With the light apparatus, since an outer wall 24*a* of an outer tube 18*a* of the discharge tube 13*a* need not discharge light therethrough, a cold filter need not be applied thereto as in the preceding light apparatus of FIGS. 1 to 3 described above. Consequently, an entire inner face of the outer wall 24*a* of the outer tube 18*a* is formed as a cold mirror.

It is to be noted that, while, in the light apparatus of the embodiments described above, the convex lens 14 is disposed on the outer side of the light discharging portion 25 or 25*a* in order to produce parallel rays of light, such a convex lens is not always necessary. Further, the application of the present invention is not limited to such an OHP and a liquid crystal projector as described above, but the present invention can be applied to various technical fields.

Having now fully described the invention, it will be apparent to one of ordinary skill in the art that many changes and modifications can be made thereto without departing from the spirit and scope of the invention as set forth herein.

What is claimed is:

1. A light apparatus, comprising:

a reflecting plate having a hollow spheroidal profile which is a shape obtained by revolving an ellipse around its major axis, said reflecting plate having an inner face formed as a spheroidal mirror which has first and second focuses, said reflecting plate being cut away along a plane perpendicular to the major axis adjacent the second focus to form an opening;

an internal mirror mounted in said opening of said reflecting plate in such a manner as to connect to the spheroid of said reflecting plate to close the inner face of said reflecting plate to form part of said spheroidal mirror; and a light emitting member formed integrally with said internal mirror and including a light source member accommodated therein at the second focus of said spheroidal mirror, said light emitting member having a light discharging portion formed at a portion thereof at an end of the major axis of said spheroidal mirror.

2. A light apparatus according to claim 1, wherein said light discharging portion of said light emitting member has a cold filter provided at a central portion of a surface thereof, said cold filter allowing visible rays of light to transmit therethrough.

3. A light apparatus according to claim 2, wherein said light discharging portion of said light emitting member further has a cold mirror provided on said surface thereof around said cold filter, said cold mirror preventing transmission of visible rays of light therethrough.

4. A light apparatus according to claim 1, wherein said light emitting member is formed in a double layer tube consisting of said light source member and an outer tube in which said light source member is accommodated, and said internal mirror is formed on said outer tube.

5. A light apparatus according to claim 4, wherein said light source member is a metal halide lamp.

6. A light apparatus according to claim 1, wherein said light source member is a high voltage discharge lamp.

7. A light apparatus, comprising:

a reflecting plate having a hollow spheroidal profile which is a shape obtained by revolving an ellipse around its major axis, said reflecting plate having an inner face formed as a spheroidal mirror which has first and second focuses, said reflecting plate being cut away along a plane perpendicular to the major axis adjacent the first focus to form an opening;

an internal mirror mounted in said opening of said reflecting plate in such a manner as to connect to the spheroid of said reflecting plate to close the inner face of said reflecting plate to form part of said spheroidal mirror; and a light emitting member formed integrally with said internal mirror and including a light source member accommodated therein at the first focus of said spheroidal mirror;

said reflecting plate having a light discharging portion formed at a portion thereof at an end of the major axis of said spheroidal mirror adjacent the second focus of said spheroidal mirror.

8. A light apparatus according to claim 7, wherein said light emitting member has a cold mirror provided on a surface thereof adjacent the first focus of said spheroidal mirror, said cold mirror preventing transmission of visible rays of light therethrough.

9. A light apparatus according to claim 7, wherein said light emitting member is formed in a double layer tube consisting of said light source member and an outer tube in which said light source member is accommodated, and said internal mirror is formed on said outer tube.

10. A light apparatus according to claim 7, wherein said light source member is a high voltage discharge lamp.

11. A light apparatus according to claim 10, wherein said light source member is a metal halide lamp.

12. A light apparatus according to any one of the preceding claims, further comprising a lens disposed on the outer side of said light discharging portion.

13. A light apparatus according to any one of claims 1–11, wherein said light source is utilized for a liquid crystal projector.

14. A light apparatus according to any one of claims 1–11, wherein said light apparatus is utilized for an overhead projector.

* * * * *